United States Patent [19]

Ficken et al.

[11] Patent Number: 4,594,838

[45] Date of Patent: Jun. 17, 1986

[54] CAPPING METHOD AND APPARATUS FOR A BEVERAGE VENDOR

[75] Inventors: Leonard A. Ficken; Gerald J. Podgorny; James A. Boyle, all of St. Louis County, Mo.

[73] Assignee: UniDynamics Corporation, Stamford, Conn.

[21] Appl. No.: 660,105

[22] Filed: Oct. 12, 1984

[51] Int. Cl.[4] ..... B65B 3/04; B65B 7/28

[52] U.S. Cl. ..... 53/471; 53/485; 53/281; 53/310; 53/325

[58] Field of Search ..... 53/309, 310, 290, 311, 53/312, 314, 293, 306, 75, 77, 471, 487, 488, 485, 268, 281

[56] References Cited

U.S. PATENT DOCUMENTS

| | | | |
|---|---|---|---|
| 2,060,967 | 11/1936 | Anderson | 53/310 |
| 2,264,738 | 12/1941 | Blann | 53/310 X |
| 2,361,364 | 10/1944 | Bell | 53/309 X |
| 2,704,629 | 3/1955 | Andre et al. | 53/306 |
| 2,714,980 | 8/1955 | Schlayer et al. . | |
| 2,717,730 | 9/1955 | Blann | 53/306 |
| 3,029,574 | 4/1962 | Anderson | 53/306 X |
| 3,345,801 | 10/1967 | West | 53/311 |
| 3,533,211 | 10/1970 | Einnehmer | 53/471 |
| 3,566,577 | 3/1971 | Occhipinti . | |
| 3,629,989 | 12/1971 | Reinecke | 53/306 X |
| 3,864,898 | 2/1975 | West | 53/309 X |
| 4,077,188 | 3/1978 | Strombeck et al. | 53/310 |

*Primary Examiner*—Horace M. Culver

*Attorney, Agent, or Firm*—Senniger, Powers, Leavitt and Roedel

[57] ABSTRACT

In a beverage vendor, a cup capping mechanism in which a cap is removed from a remote location to a stationary cup station, placed on the cup and then pressed down onto the rim of the cup by a sliding motion over the upper surface of the cup beginning at one side and progressing to the other. A locking mechanism is provided which prevents opening of the cup station delivery door during the capping operation.

19 Claims, 20 Drawing Figures

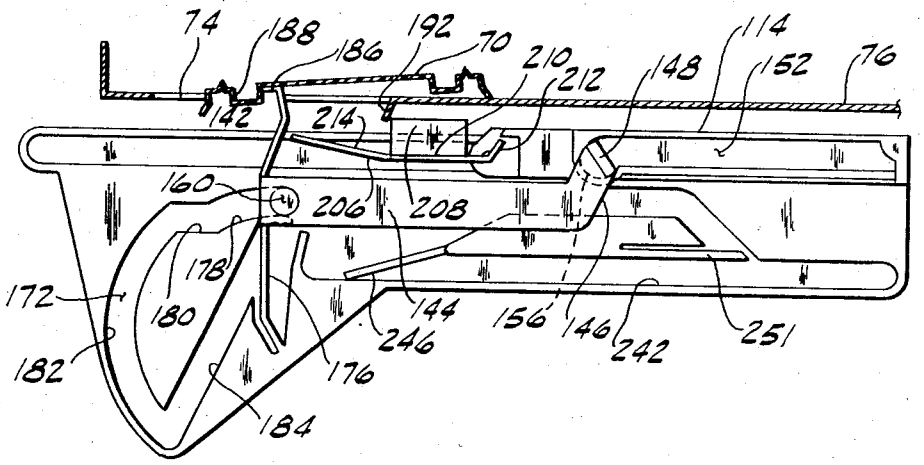
FIG. 8
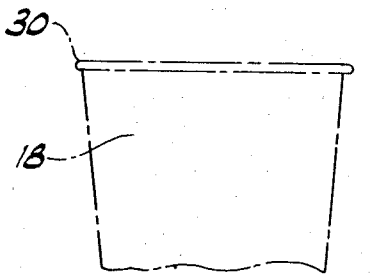
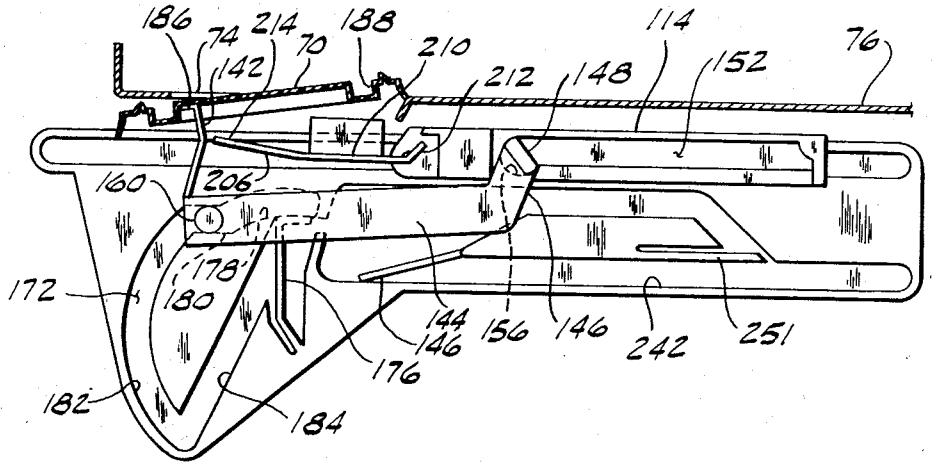
FIG. 9
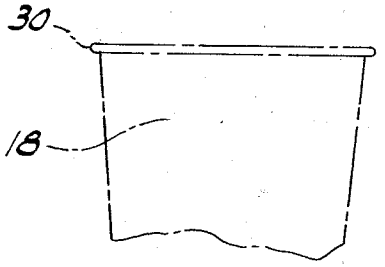

CAPPING METHOD AND APPARATUS FOR A BEVERAGE VENDOR

BACKGROUND OF THE INVENTION

The present invention pertains to beverage vendors and, more particularly, to a capping method and apparatus for placing caps on cups filled with a selected beverage at a vending station of the vendor. Beverage vendors normally provide a selection of hot and/or cold beverages which dispense the selected beverage into a cup positioned at a cup station where, after filling, it can be easily removed by the customer. Since such vendors are often at locations remote from where a customer wishes to consume the selected beverage, inability of the equipment to place a cap on the cup frequently results in the spillage of some of the contents as the customer attempts to transport the open cup.

Some designs of capping mechanisms have been developed which, for various reasons, have not found commercial acceptance. Also, many capping devices have been designed in connection with product filling equipment other than vending machines, which designs are not suitable for incorporation into a vending machine because of space and other limitations unique to the vending industry.

SUMMARY OF THE INVENTION

The present invention overcomes the above described difficulties and disadvantages associated with prior art devices by providing a method and apparatus for capping a cup at a cup station in a beverage vending machine.

In the present invention a vendor is provided having a stationary cup station to which a cup is delivered from a cup supply, means operable upon registration of credit for a vend and selection by a customer to fill the cup at the cup station with a beverage, means for capping each cup after it has been filled at the cup station with the filled and capped cup retrievable by the customer from the cup station, which includes means for holding a stack of caps in the vendor spaced from the cup station, means operable on filling the cup at the cup station for ejecting the lowermost cap of the stack and carrying it to and placing it on a filled cup at the cup station and then pressing the cap down on the cup.

The capping mechanism preferably includes a slide member mounted for horizontally reciprocating movement between a first position beneath the cap holding means and a second position over the cup station. An ejector member is provided which is engagable with a lower surface of the lowermost cap in the cap holding means so as to eject the cap therefrom as the slide member moves from the first position beneath the cap holding means. The slide member is provided with means for supporting the cap for movement with the slide member, and further means are provided for holding the cap against the cap supporting means as the slide member moves from beneath the cap holding means to its position over the cup at the cup station.

A cap tilting mechanism is preferably provided to tilt the cap at the cup station so that a lip portion thereof engages a rim portion of the cup. After the cap is tilted, a member engages the upper surface of the cap adjacent the lip portion already engaging the rim portion of the cup and is drawn laterally across the upper surface of the cap so as to cause the remainder of the lip to engage the remainder of the rim to affix the cap to the cup.

The ejector member is preferably pivotally mounted to the slide member and engagable with the lower surface of the lowermost cap in a contoured portion thereof such that movement of the slide member away from the cap holding means causes the ejector member to move the cap generally laterally away from the stack of caps in the holding means. A camming mechanism is associated with the ejector member to cause it to pivot downwardly away from the lowermost cap which it has picked up, as the slide member moves from beneath the cap holding means towards its position over the cup at the cup station, so that the cap is placed on the cap supporting means for movement therewith.

In the method of the present invention, a cup to be capped in a beverage vendor is first delivered from a cup storing device to a stationary cup station where the cup is accessible to the customer. The cup is then filled with the customer's beverage selection and a cap is then ejected from a stack of caps disposed remote from the cup station. The ejected cap is carried from the stack of caps to the cup station and then a portion of a lip of the cap is positioned over the rim portion of the cup. The capping member is then moved laterally across and in engagement with the upper surface of the cap from the portion of the lip already on the cup to an opposite side of the cap so as to cause the lip of the cap to engage the lip of the cup around its complete periphery to affix the cap to the cup.

Other objects and features will be in part apparent and in part pointed out hereinafter.

BRIEF DESCRIPTION OF THE DRAWINGS

FIG. 8 is a partial front view of the capping mechanism, illustrating one of the cam tracks for the ejector and slider mechanisms with the other cam track removed for clarity;

FIG. 9 is a view similar to FIG. 8, showing the camming rollers moved to a different portion of the cam tracks;

Corresponding reference characters indicate corresponding parts throughout the several views of the drawings.

DETAILED DESCRIPTION OF PREFERRED EMBODIMENT

The present invention is designed to be utilized in any type of beverage vending machine, for example, hot and/or cold beverage dispensers where a stationary cup station is utilized. Therefore, a detailed description of a vendor such as that illustrated generally at 10, will not be provided herein except to the extent necessary to explain its interaction with the present invention. Generally, the capping apparatus of the present invention is activated in the proper sequence by the controls for the beverage vendor 10, but otherwise operates independently therefrom.

Figure 1:
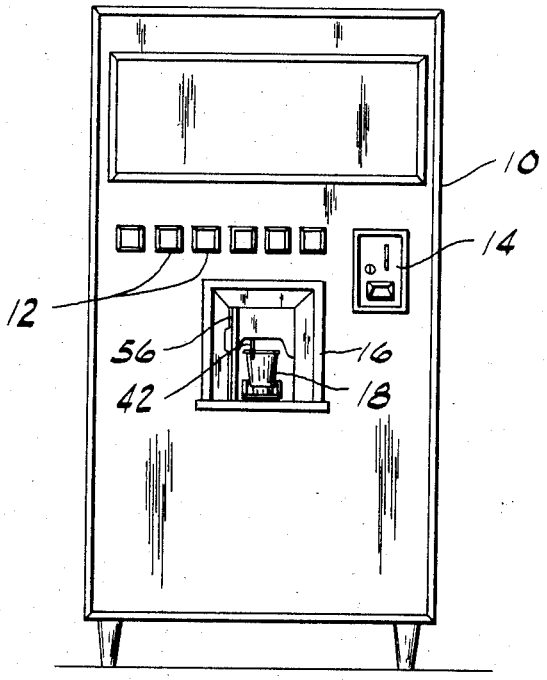
FIG. 1 is a front elevational view of a vending apparatus incorporating the preferred embodiment of the present invention.

As shown in FIG. 1, a typical beverage vendor 10 is illustrated having a plurality of selection means 12, in the form of buttons having an indication thereon of what beverage will be selected by pushing a particular button, although there are many other forms of selection means known in the art, any of which could be utilized with the present invention. Coin receiving means 14 is provided for accepting coins and the like to establish credit for a selected vend in a conventional manner. Such vending machines 10 are provided with a cup station 16 to which a cup 18 is delivered from a remote cup storage turret (not shown) within the machine which contains a plurality of the cups 18 and presents them to the cup station 16 in a well known manner. The beverage selected by a customer is then delivered into the cup by other well known means (not shown) to fill the cup 18 with the beverage selected by the customer.

Figure 2:
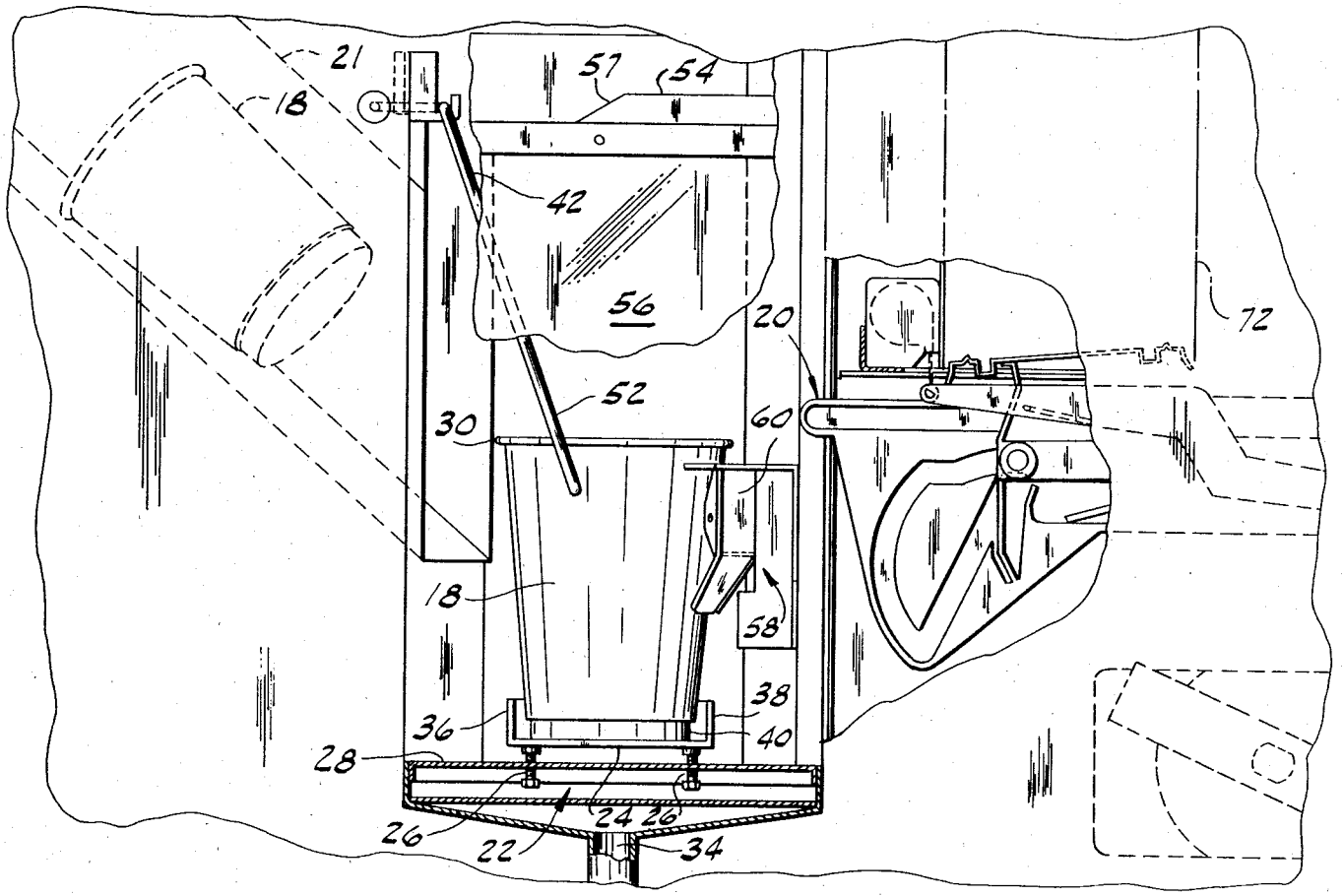
FIG. 2 is an enlarged portion of the view of the vendor of FIG. 1 in the area of the cup station and partially cut away, illustrating the capping mechanism of the present invention.

Referring now to FIG. 2, the cup capping mechanism of the present invention, shown generally as 20, is preferably mounted to the inner surface of the front cabinet door of the vendor 10, adjacent the cup station 16, as illustrated. Such cabinet doors are generally constructed of at least two parallel spaced sheet metal plates which permits the capping mechanism 20 to be easily bolted or otherwise secured to the inner plate.

Although means are generally provided in beverage vendors for absorbing some shock as the cup 18 is delivered to the cup station 16 through a cup chute 21, or the like, from the delivery mechanism mentioned above, such shock absorbing means are generally inadequate for properly positioning a cup 18 in the cup station for use with the cup capping mechanism 20 of the present invention. As can be appreciated, it is necessary to fairly accurately position a cup each time it is delivered to the cup station 16 so that the cap to be placed on it will be accurately positioned by the capping mechanism 20. Therefore, a unique cup receiving and supporting mechanism, shown generally as 22, is provided in the present invention to achieve proper location of a cup 18 in cup station 16.

Figure 3:
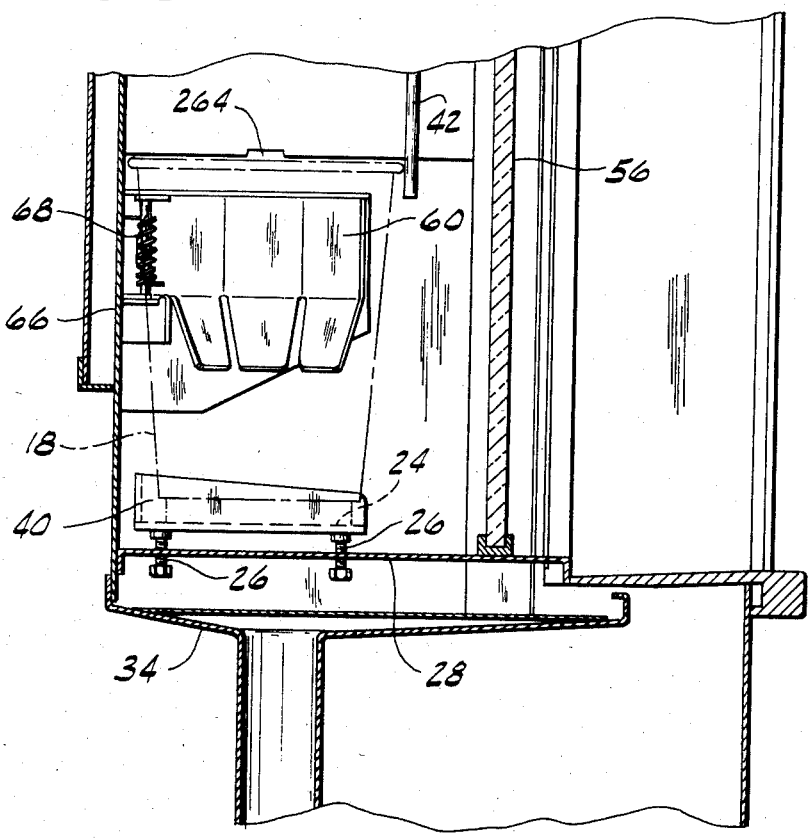
FIG. 3 is a partial cross-sectional side view of the cup station looking from the left hand side of FIG. 2, illustrating the cup locating and supporting mechanisms of the preferred embodiment.
Figure 4:
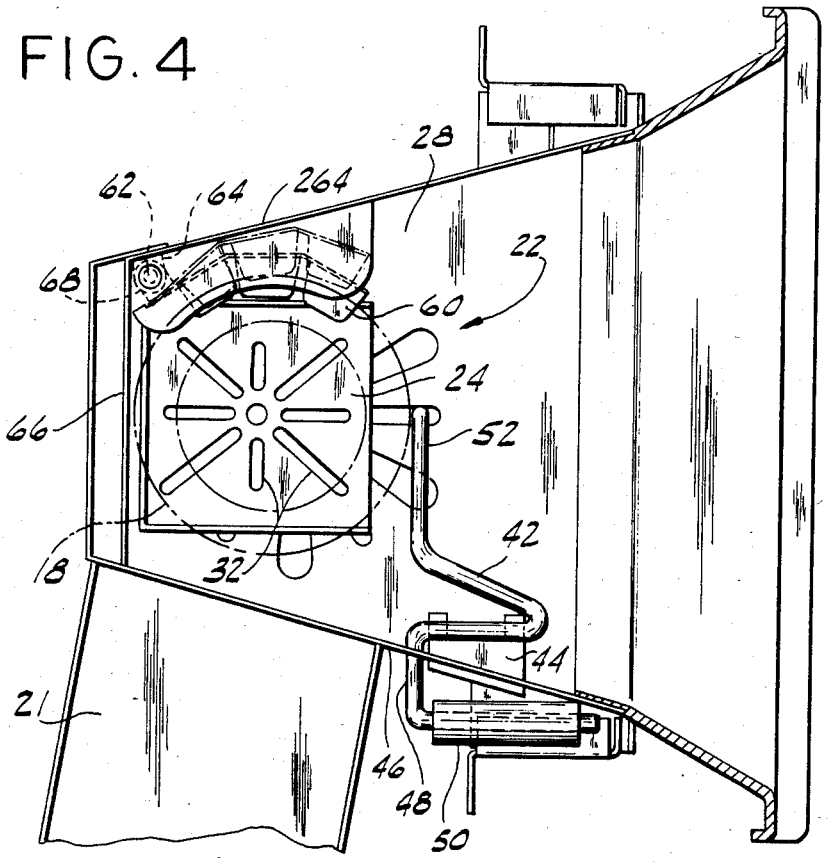
FIG. 4 is a partial top view of the cup station showing further details of the cup locating and supporting mechanism of the preferred embodiment.

Referring to FIGS. 2 through 4, a first portion of the cup receiving and supporting mechanism 22 is a supporting base plate 24, adjustably positioned, for example, by a plurality of screws 26 to the stationary floor plate 28 of the cup station 16. Screws 26 permit proper height and leveling adjustments to allow the base plate 24 to be adjusted so that a cup 18 will have its upper rim 30 properly vertically located for receiving a cap from the capping mechanism 20. As seen in FIG. 4, the base plate 24 is provided with a plurality of drain holes 32 through which excess beverage or spillage may pass to be received by the drain mechanism 34 (FIG. 3) of the vendor 10, which is of conventional construction.

In, for example, a cold beverage vendor, ice is often first delivered to a cup 18 positioned at the cup station 16, prior to delivery of the selected beverage. Since delivery of ice or beverage generally causes the cup to bounce and become displaced in the cup station, and since the ice and/or beverage is delivered at an angle with respect to the center of the cup which causes the cup to be forced away from the direction from which the ice or beverage is delivered, it is necessary to maintain the cup in the desired location in the cup station 16 while it is being filled. In the preferred embodiment of the present invention, to prevent this undesirable displacement of the cup the base plate 24 is provided with side rails 36 and 38 disposed on opposite sides of the desired cup location, and are only slightly separated from the base 40 of the cup 18 so that the cup, although permitted limited movement, will not be permitted to bounce and dislocate itself from the desired capping position in the cup station 16.

Since the ice, for example, often strikes the upper portion of the cup and could cause it to tip over or become dislodged enough that it could move out of the desired location in the cup station 16, an additional positioning lever 42 is provided which engages the upper portion of the cup 18 when positioned in the cup station 16. Positioning lever 42 is pivotally mounted by a bracket 44 secured to the upper left wall (as viewed from the front of vendor 10) of the sheet metal form 46 which forms the cup station 16. Adjacent the bracket 44 on the bent end portion 48 of lever 42 is a counter-balance 50 which keeps the cup engaging portion 52 of lever 42 engaged with the side of the cup 18 during filling.

Since lever 42 would otherwise be in the way when a customer attempted to remove the cup 18 from the cup station 16 after it has been filled and capped, a camming member 54 (FIG. 2) is provided to move the lever 42 out of the way so that the customer can easily remove the cup 18 from the cup station 16. The camming member 54 is secured to the upper portion of the cup station delivery door 56 which is transparent and covers the cup station during the filling and capping cycle, as described more fully below. The delivery door 56 is slid to the left after the cup has been capped, which causes the sloped camming surface 57 of camming member 54 to engage the bent end portion 48 of lever 42 and pivot the lever out of the way.

A cup shock absorbing mechanism, shown generally at 58, as mentioned above, is provided which slows the cup 18 down as it is delivered from the cup chute 21 into the cup station 16, so that it does not bounce and, thus, not be properly located in the cup station. In the preferred embodiment, the shock absorbing mechanism 58 is composed of a contoured deflector plate 60 pivotally mounted by a pin 62 secured by a mounting bracket 64 to the back wall 66 of cup station 16 so that deflector plate 60 can pivot about the vertical axis of pin 62 as a cup falls against deflector plate 60.

In addition, a coil spring 68 is provided to bias the deflection plate 60 towards the cup 18, but which is weak enough to allow the deflector plate 60 to be pivoted about pin 62 slightly, in order to absorb some of the momentum of the cup as it is falling towards the base plate 24 of the cup receiving and supporting mechanism 22. Deflector plate 60 is formed of sheet metal, such as stainless steel, and is contoured to engage the outer surface of a cup 18 around the portion of its periphery to assist in keeping the cup 18 in its proper location during filling and capping.

Figure 5:
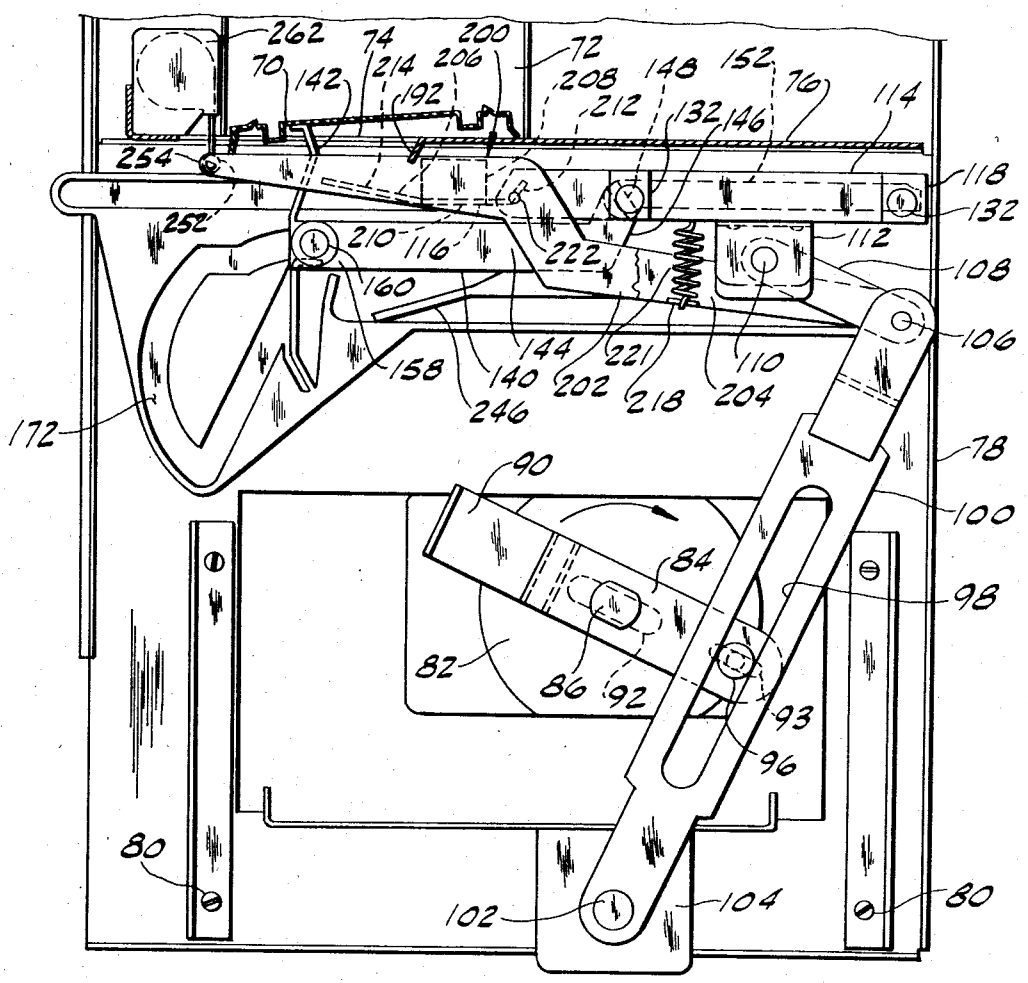
FIG. 5 is a cross sectional view of the capping mechanism only as viewed from the front of the vending machine, with a portion of its housing and camming track removed for clarity and with the slider mechanism illustrated in a retracted position.
Figure 5:
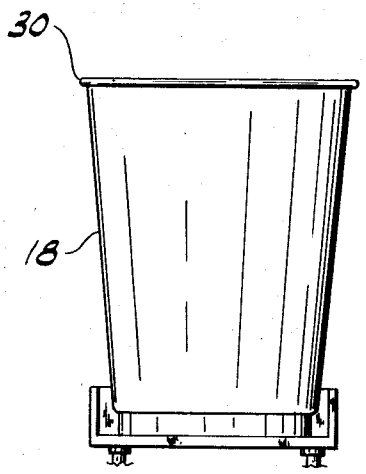
Figure 6:
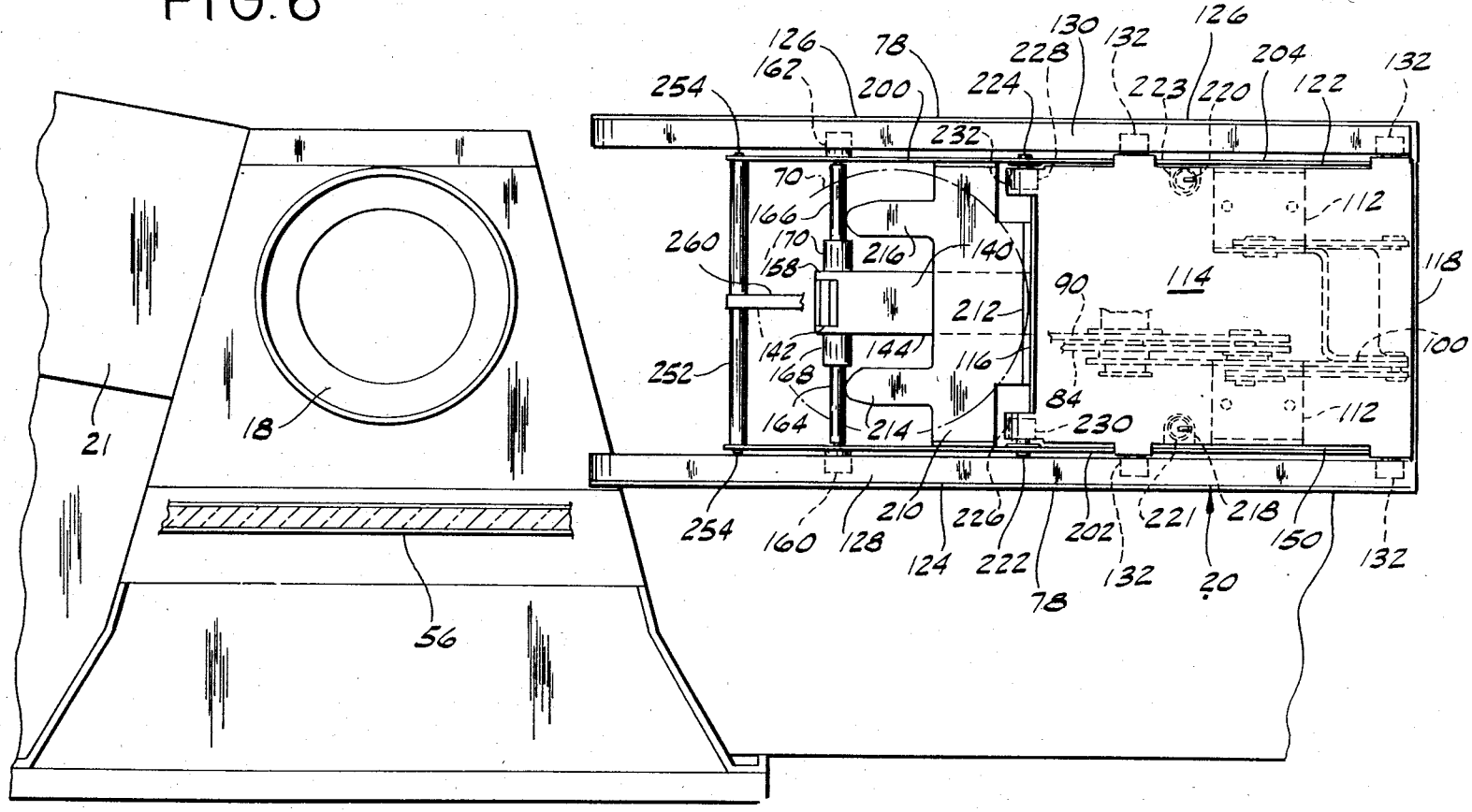
FIG. 6 is a top view of the capping mechanism in the retracted position with the upper portion of the housing removed for clarity.
Figure 7:
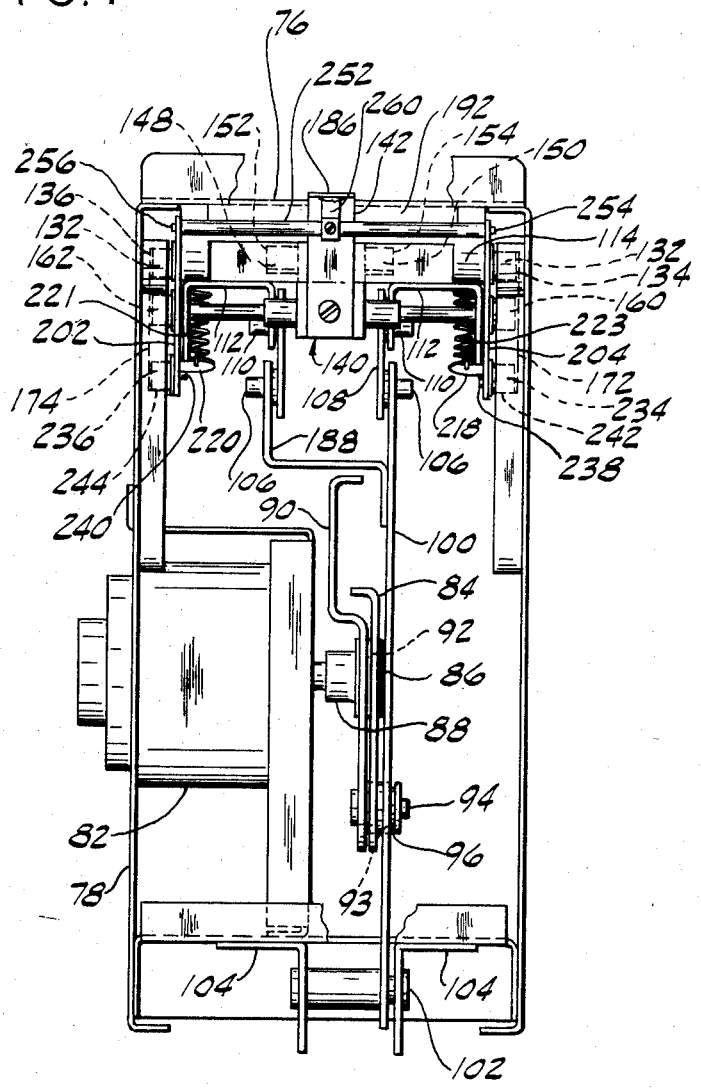
FIG. 7 is an end view of the capping mechanism looking from the left side of FIG. 5.

Referring now to the capping mechanism 20, with particular reference to FIGS. 5 through 7, a plurality of caps 70 (only one being shown) are stored in a cap storage device constituted by a turret (not shown) of conventional construction containing a plurality of tubes for storing caps and which is positioned above a sleeve 72 (FIG. 5). The turret is rotatably mounted above sleeve 72 to supply the sleeve with a stack of caps out of each tube. For example, when the height of the stack of caps in the sleeve is reduced slightly as sensed by a microswitch (not shown) near the top of sleeve 72, the turret is rotated so that a tube containing another stack of caps is disposed over the sleeve so the caps drop a short distance into the tube on top of those caps already in the tube. This process continues until all of the stacks of caps in the turret have been depleted. The stack of caps in sleeve 72 from which cap 70 is shown as presently being removed is positioned over an opening 74 defined in an upper cover plate 76 of the capping mechanism 20. The lowermost cap 70, positioned over the opening 74, is removed therethrough by the capping mechanism 20, as described below.

Cover plate 76 forms the upper surface of a housing 78 for the capping mechanism 20 which permits the mechanism contained therein to be easily secured to or removed from the cabinet door adjacent the cup station 16. A plurality of bolts, such as 80, secure the capping mechanism 20 to the cabinet door, to hold it securely in position during use. The capping mechanism 20 is thus essentially self contained, which permits it to be easily added to or removed from the door of the vendor 10.

A main capping mechanism drive motor 82 (a generator, best seen in FIGS. 5 and 7) is mounted to the housing 78 and provides all of the driving force and timing for movement of the capping mechanism 20. A first drive lever arm 84 is fixed to the drive motor output shaft 86 through bushing 88 for rotation therewith, clockwise as viewed in FIG. 5. A second drive lever arm 90 is supported on bushing 86 through a slotted opening 92 which permits the second drive lever arm 90 to move longitudinally of the first drive lever arm 84. The outer end portion of the first drive lever arm 84 is longitudinally slotted at 93 and receives a pin 94 which is fixedly secured to the second drive lever arm 90. Pin 94 supports a cylindrical bushing 96 which in turn is received in a slot 98 formed in a driven lever arm 100. Driven lever arm 100 is, in turn, pivoted at its lower end portion about fixed pin 102 mounted in brackets 104 to housing 78.

The upper end portion of lever arm 100 branches into a U-shaped member (see FIG. 7) which is pivotally secured to pins 106 which are fixed at outer end portions of links 108. The opposite end portions of links 108 have further pins 110 fixed thereto, which, in turn, are pivotally received by a pair of brackets 112. Brackets 112 are, in turn, fixed to a slider or slide member 114 which may also be referred to as a carriage. The rest of the capping mechanism 20, as described below, is actuated by and/or connected to the slider 114 and is thus driven by the interconnecting drive mechanism, discussed above, which connects the drive motor 82 to the slider 114.

A cycle of operation in the capping mechanism 20 is established by a complete rotation of the output shaft 86 of drive motor 82. Drive motor 82 is controlled by a conventional switching mechanism which upon receipt of a signal from the main vending control unit (not shown) initiates operation of the motor for one complete rotation of draft 86 and is thereafter shut down with shaft 86 in essentially the same location where it began, i.e., after a 360° rotation of the drive shaft.

Slider 114 is generally of rectangular block shape with its width and length substantially greater than its thickness. The upper surface of slider 114 is preferably continuous and smooth for reasons stated below. Slider 114 is preferably composed of two halves of essentially mirror image, which permits ease of assembly of the various components connected to it.

As seen in FIGS. 5 and 6, the slider 114 is shown in its retracted position with its forwardmost edge 116 positioned about even with the trailing edge of the lowermost cap 70 in sleeve 72. The rear surface 118 of slider 114 is disposed just within the rear edge of housing 78. As seen in FIG. 6, slider 114 extends for a substantial portion of the width of housing 78, but with its side edges 120 and 122 spaced inwardly from the sides of the housing to accommodate other portions of the mechanism described below.

Mounted to the inside front and rear walls 124 and 126 of housing 78 are a pair of mirror image cam track defining members 128 and 130, respectively, which define camming tracks in which several components of the capping mechanism are supported and guided, including slider 114. Slider 114 is provided with four rollers 132 rotatably mounted on pins secured to slider 114. Rollers 132 extend into tracks 134 and 136 (FIG. 7) and support the slider 114 for constrained movement along the tracks 134 and 136. Tracks 134 and 136 are completely horizontal along their length and support the slider for back and forth horizontal movement between a first position remote from the cup station 16 on an opposite side of the cap 70 positioned to be removed from sleeve 72, and a second position adjacent the cup station 16 (see FIG. 13).

Referring now to the ejector mechanism, shown generally at 140, as seen in FIGS. 5 and 6 it is in the retracted position with a contoured rigid ejector member 142 thereof engaging the lower surface of the lowermost cap 70 in its position within sleeve 72. Ejector mechanism 140 is carried by slider 114 whose forward movement from the retracted position causes the ejector to remove the cap 70 from the sleeve 72 so that it can subsequently be carried to the cup station, in the manner described above.

The main body 144 of ejector mechanism 140 has an upwardly offset rear portion 146 which extends upwardly into the central region of slider 114 and has a pair of camming members 148 and 150 extending out on opposite sides of the main body 144 which are received in corresponding cam tracks 152 and 154 formed internally in slider 114 in spaced relation to permit the main body 144 to freely slide back and forth horizontally therein when the camming surfaces of camming members 148 and 150 are properly disposed in the cam tracks.

Figure 16:
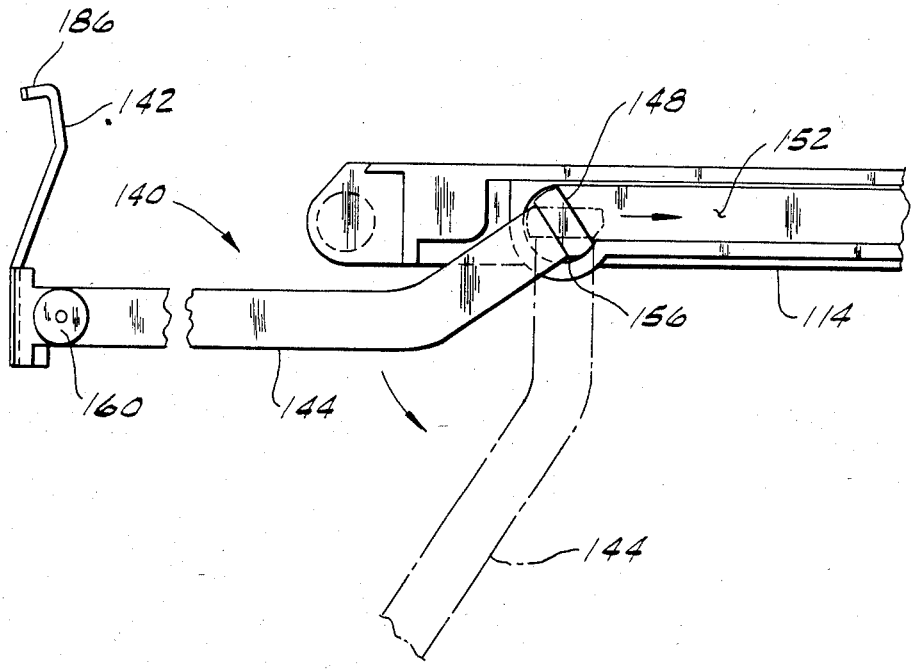
FIG. 16 is a schematic side view illustration of the interconnection of the ejector mechanism with the slider.

Operation and interconnection of the camming members 148 and 150 with their respective camming tracks 152 and 154 can be seen more clearly in FIG. 16. As there illustrated, the retracted position of the ejector mechanism 140 is shown in phantom and a partially rotated position of the main body 144 of the ejector mechanism 140 is illustrated in solid line position, as is the main body of the slider 114. In the retracted position, where the slider would be at its rearmost location, the ejector would be engaged with the lowermost cap 70 and the camming member 148 would be contained within the annular end portion 156 of cam track 152. As the slider 114 moves forward, the camming member 148 and thus the ejector mechanism 140 are captive and are moved forward with the slider 114 to thus cause the ejector 142 to dislodge the cap 70 from the sleeve 72.

As the main body 144 of the ejector is cammed downwardly, in the manner explained below, the camming member 148 is rotated within the annular end portion 156 so that it becomes free of the annular end portion and is permitted to slide, relative to the slider 114, within the track 152. This position of the camming member 148 thus stops further forward movement of the ejector mechanism 140 at a desired point in the capping cycle while permitting continued forward movement of slider 114.

Referring again to FIGS. 5–7, a front portion 158 of main body 144 of ejector mechanism 140 is provided with a pair of further camming rollers 160 and 162 (FIG. 6) that are mounted on the outer ends of pins 164 and 166 which, in turn, have their inner ends fixedly received in cylindrical extensions 168 and 170, respectively, of main body 144 of ejector mechanism 140. Rollers 160 and 162 are free to rotate on pins 164 and 166 and are received in camming tracks 172 and 174, respectively, formed in front and rear cam track defining members 128 and 130, respectively. Camming tracks 172 and 174 are mirror image and cause the ejector member 142 to be pivoted downwardly as it is moved from the retracted position, to remove the lowermost cap 70 from the sleeve 72.

Movement of the ejector mechanism 140 can best be described in connection with the sequence of FIGS. 8–11 wherein the roller 160 is shown at various positions within the camming track 172. Referring first to FIG. 8, roller 160 is shown at its beginning location in the cycle of operation of the capping mechanism 20 and the slider 114 is at its rearmost position so that ejector 142 is in engagement with the lower surface of the countoured cap 70. In this position, the roller 160 bears on a horizontal surface formed by a flexible direction guide 176 which can be formed of the same piece of material forming the member 128 (i.e., an elastically deformable plastic material) or can be independently formed of a material of any desired resiliency and secured to the member 128.

The purpose of direction guide 176 is to prevent the camming roller 160 from moving in a wrong direction in the continuous camming track 172, when it begins a cycle. The intended course of roller 160 is counterclockwise so that as the roller 160 leaves the flat upper surface of direction guide 176 it travels down an arcuate ramp 178. This initial movement causes the ejector 142 to pull the lowermost cap 70 through the cap opening 74 in the upper cover plate 76 and out of the sleeve 72. Roller 160 then continues along a flat horizontal section 180, which continues to draw the cap 70 out of the sleeve.

Figure 10:
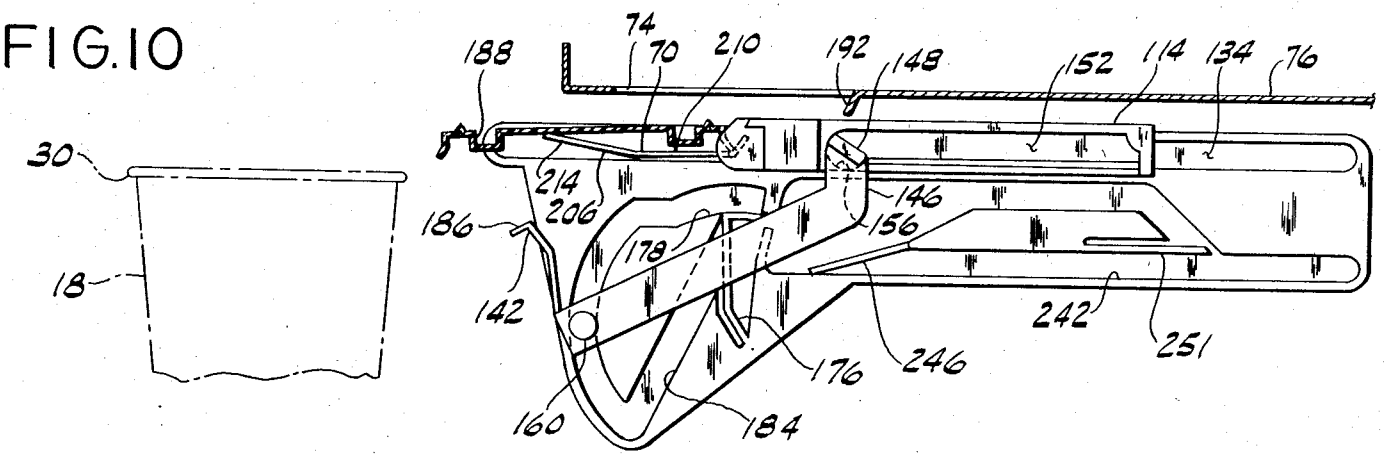
FIG. 10 is a view similar to FIG. 8, with the camming rollers sequenced further along in the camming tracks.
Figure 11:
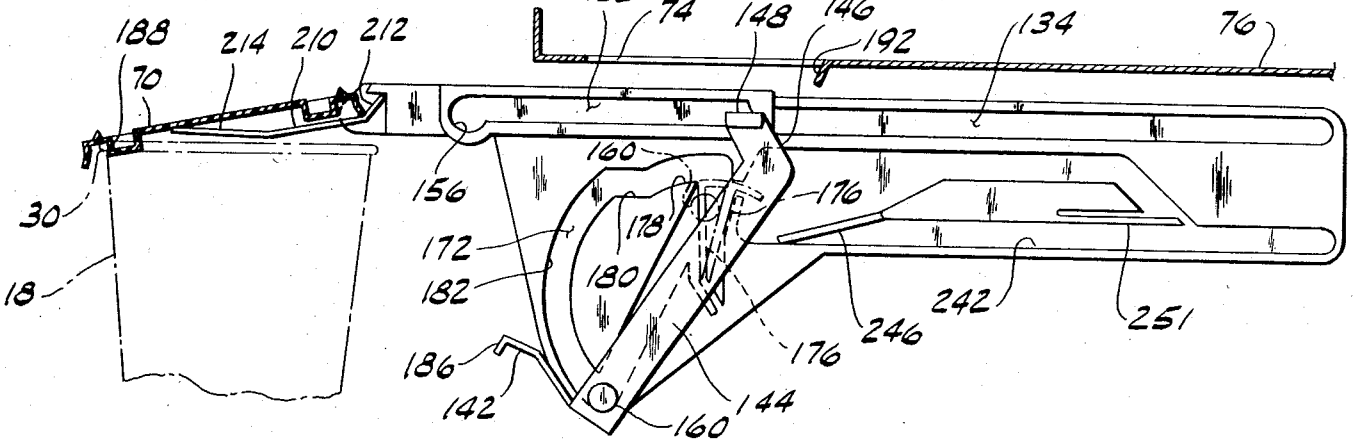
FIG. 11 is a further view similar to FIG. 8, showing the camming rollers moved to yet a further position in the camming tracks.

As the cap is deposited on a further portion of the capping mechanism, described below, the roller 160 (best seen in FIG. 10) then continues through a further arcuate portion 182 and draws the ejector member 142 down away from the cap 70 so that it is no longer in engagement therewith. As the roller 160 moves to the lowermost end portion of this further arcuate section 182, as seen in FIG. 11, the camming member 148 on the end of the main body 144 of the ejector moves out of the arcuate portion of cam track 152 of slider 114 and permits the slider to continue its movement toward the capping station while the ejector mechanism 140 remains stationary and pivoted out of the way of further movement of the slider 114.

After the slider has moved to its fully extended position adjacent the cup station and is returning to its fully retracted position for beginning the next cycle, it picks up the ejector mechanism 140 as the camming member 148 strikes the arcuate end 156 of the camming track 152 in slider 114. The roller 160 is then drawn up the straight slanted ramp 184 and forces the direction guide 176 to flex out of the way (see phantom view on FIG. 11) and direct roller 160 back to its initial starting position, as shown in FIG. 8, and the direction guide 76 returns to its normal rest position where roller 160 is resting on its upper surface.

As roller 160 passes up the ramp 184, camming member 148 is rotated within the arcuate end portion of camming track 152 in slider 114 and is thus locked in this arcuate portion for the next cycle. Although not specifically shown, as the ejector member 142 is brought back up into its initial position the tip 186 thereof actually strikes the extended contour 188 of cap 70, which is an annular groove in the cap, and causes the cap 70, and those above it, to be moved upward slightly and then cap 70 drops downwardly on top of the ejector member 142 so that the tip 186 will be immediately adjacent the contoured portion 188 which it contacts on the next cycle to pull the cap 70 from the sleeve 72.

Figure 19:
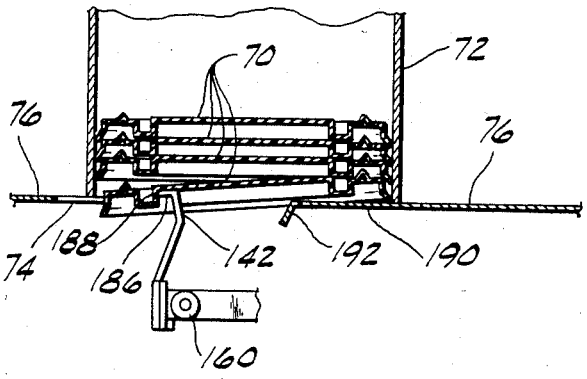
FIG. 19 is a schematic side view illustration of a cap being removed from the cap storing turret.
Figure 20:
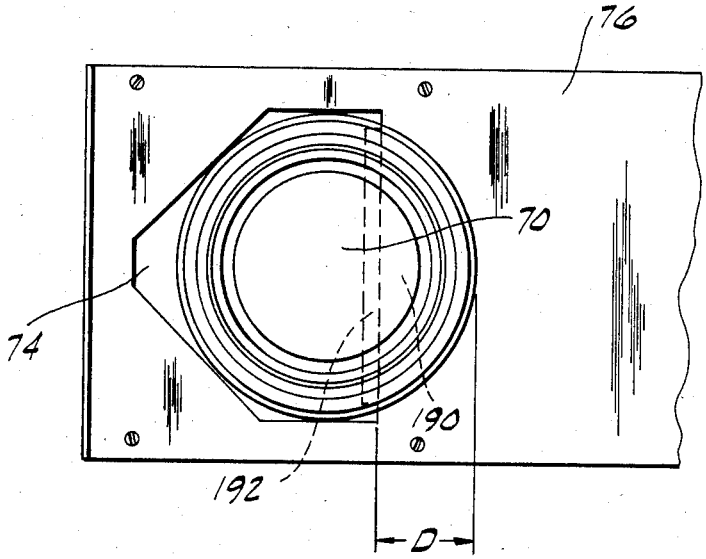
FIG. 20 is a top view of the capping mechanism housing and the bottom cap shown in the schematic illustration of FIG. 19.

Also, the opening 74 in the upper cover plate 76 (see FIGS. 19 and 20) of the capping mechanism housing 78 is specifically designed to assist in separating the lowermost cap 70 from those contained directly above it in the stack in the sleeve 72. The shelf 190 formed by that portion of the upper cover plate 76 between the edge of the cap 70 and the cap opening 74 extends a distance D (FIG. 20) which is approximately one third of the diameter of the cap, so that the cap 70 tends to naturally fall out of the opening 74, away from the remainder of the caps in the stack. This slight angling of the lowermost cap 70 assists in initial separation of the cap from the one immediately above it as the cap is drawn laterally out of the sleeve 72 by the ejector member 142. A flange 192 forms a short ramp at the end of shelf 190 so that the trailing edge of the cap 70 being withdrawn, slides easily out of the opening 74.

Referring now to a carrier assembly, shown generally as 200, which carries the cap from the sleeve 72 to the cup station 16 and places the cap on the cup 18, it is shown in its initial retracted position in FIGS. 5–7. Carrier mechanism 200 is comprised mainly of a pair of flat, vertically offset side plates 202 and 204 held together by a central carrier plate 206 which is welded or otherwise secured by tabs 208 to each of the side plates 202 and 204. Carrier plate 206 has a flat central region 210 which is horizontally disposed when in the retracted position, as shown in FIG. 5, and has a rear upwardly bent lip 212 and two forwardly extending prongs 214 and 216 which are slightly upwardly bent. Also, each of the side plates 202 and 204 has a bent tab 218 and 220, respectively (FIG. 6) which are positioned beneath corresponding tabs formed in the bottom of slider 114 and into which are fitted the ends of springs 221 and 223 (FIG. 7) which bias the rear portions of the carrier plates 202 and 204 upwards.

Carrier mechanism 200 is pivotally carried by slider 114 through a pair of pins 222 and 224 (FIG. 6) extending through corresponding circular holes in side plates 202 and 204, respectively. Pins 222 and 224 are mounted to cylindrical supports 226 and 228, respectively, which in turn are rotatably received in cylindrical openings 230 and 232 respectively, formed in slider 114. Cylindrical supports 222 and 224 are held in the openings 230 and 232 by the spring action of the side plates 202 and 204 which can be spread slightly to place the pins 222 and 224 and cylindrical supports 226 and 228 into the corresponding holes in the side plates. This connection pivotally supports the carrier mechanism 200 to slider 114.

At the rear portion of each of the side plates 202 and 204 are mounted rollers 234 and 236, respectively (FIG. 7), by pins 238 and 240 extending through and fixed in corresponding openings in side plates 202 and 204. Rollers 234 and 236 extend into camming tracks 242 and 244 respectively, formed in the cam track members 128 and 130.

Figure 12:
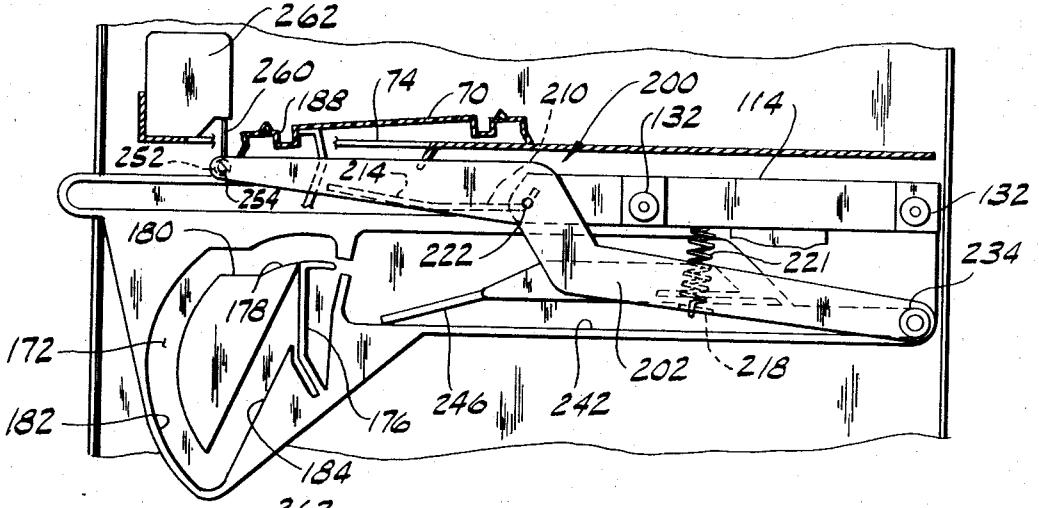
FIG. 12 is a partial front view of the capping mechanism of the present invention, showing the slider and cap carrier mechanisms in the retracted position.
Figure 13:
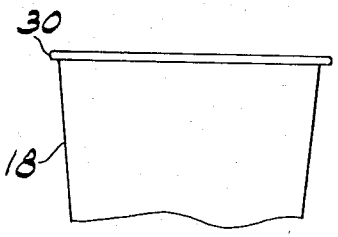
FIG. 13 is another view similar to FIG. 12, showing the camming rollers of the carrier and slider moved to a further location in their camming tracks to where the carrier is positioned at its outermost location, and a phantom view wherein the carrier is tilted to place the cap on the cup.
Figure 13:
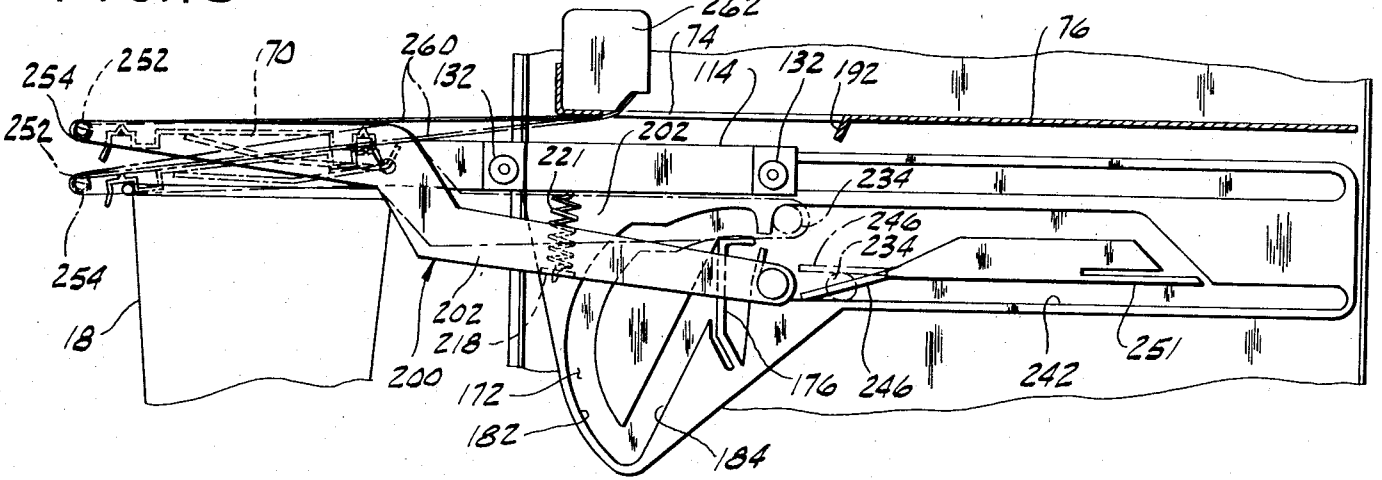
Figure 14:
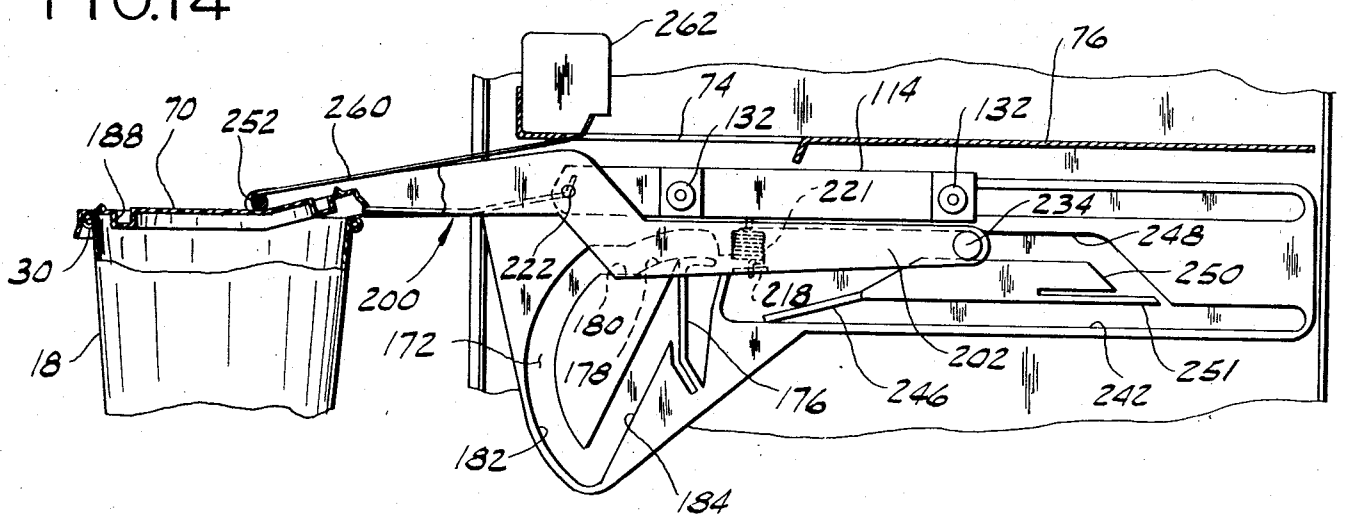
FIG. 14 is a view similar to FIG. 12 showing the cap being bent as it is pressed on the cup as the slider and carrier are retracted.

Cam tracks 242 and 244 and the movement of rollers 234 and 236 therein are best seen in FIGS. 12–14. In FIG. 12, the slider 114 and carrier mechanism 200 are shown in the fully retracted position which they would be in at the beginning of a capping cycle. Movement of roller 234 in its associated cam track 242 will be described, it being understood that the movement of roller 236 in its corresponding cam track 244 is identical. Initially, as shown in FIG. 12, roller 234 is in its rearwardmost position in cam track 242. After the cycle of operation is initiated and slider 114 is driven forward toward the cup station 16, roller 234 progresses horizontally along the camming track 242 (see FIG. 13) through a flexible direction guide 246, similar to direction guide 176, and continues on to its forwardmost position as shown in FIG. 13. Flexible guide 246 is bent out of the path of roller 234 as it passes by as shown in dotted lines. After roller 234 rolls out from under guide 246 it again assumes its normal position, as shown in solid lines, which prevents roller 234 from going back along the path in the track from where it came.

At this point, the slider 114 and carrier mechanism 200 have reached their forwardmost position of movement so that if a cap 70 were positioned thereon, as described below, it would be slightly beyond but substantially over the cup 18 positioned in the cup station 16. When roller 234 reaches this forwardmost position in the camming track 244, it is drawn upwards by springs 221 and 223 to the dotted line position shown in FIG. 13 so that the carrier plate 206 tilts the cap 70 until the lip portion thereof engages the rim portion of the cup, as shown.

At this point, the slider 114 begins its rearward movement (to the right as seen in FIG. 13) which causes roller 234 to progress along the upper portion 248 of track 242, as shown in FIG. 14. It will be noted that in the first portion of the return trip of roller 234 in the upper portion 248 of camming track 242, it is guided solely by the upper surface and is not constrained by a lower surface. The only force tending to keep roller 234 in the upper portion 248 of track 242 is provided by springs 221 and 223. However, after the point shown by the position of roller 234 in FIG. 14, roller 234 is constrained between upper and lower surfaces of camming track 242. This holds the carrier mechanism 200 rigid for reasons discussed below.

Roller 234 then continues its trip rearwardly as slider 114 continues to move to the retracted position and then as the camming track 242 slopes downwardly at 250, the front portions of side plates 202 and 204 and carrier plate 206 are brought up to their original horizontal positions for receiving the next cap 70 from sleeve 72. The last portion of movement of roller 234, to its fully retracted position, is along the initial horizontal position of the lower portion of camming track 242, through a further direction control guide 251. Guide 251 is bent out of the way by roller 234 as it passes by and prevents roller 234 from re-entering the sloped portion 250 of track 242 as it begins movement along the lower portion of track 242 at the beginning of a capping cycle.

Figure 15:
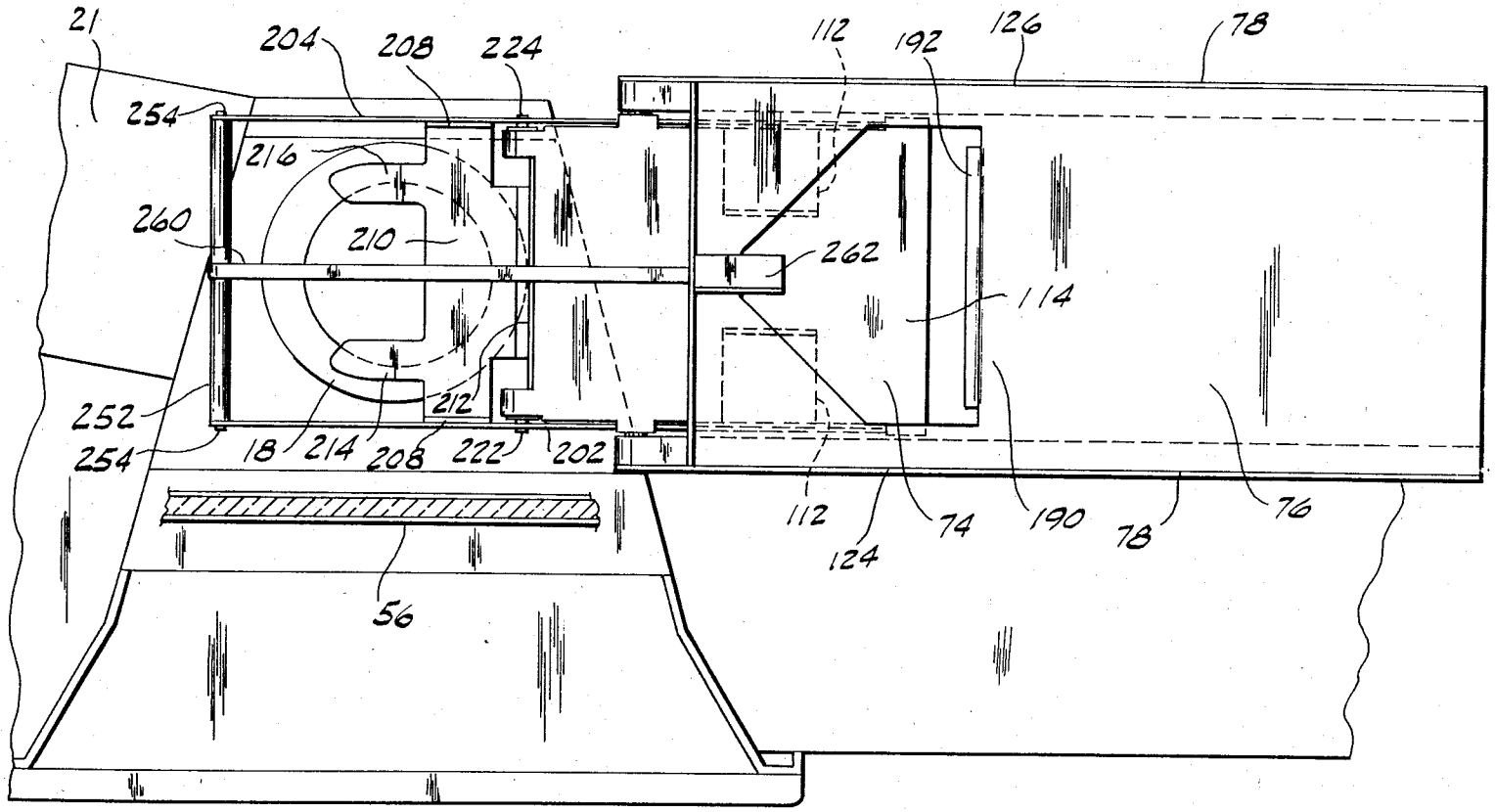
FIG. 15 is a top view of the capping mechanism, showing the components in the extended position of FIG. 13, wherein a cap would be positioned over a cup in the cup station.

Referring again to FIGS. 5–7, carried at the frontmost portion of side plates 202 and 204 and extending therebetween, is a rod 252 which is fixed at its ends 254 and 256 to side plates 202 and 204, respectively. Fixed at one end 258 to the center of rod 252 is a constant force spring 260 which is self retracting into spring housing 262. As the carrier extends from the retracted position to its extended position over cup station 16, spring 260 is withdrawn from housing 262 and lays across the upper surface of cap 70 to hold it in position on carrier plate 206 during transporting from the sleeve 72 to the cup station 16. As the carrier mechanism 200 moves from its extended position, shown in FIG. 15, over the cup station 16, to its retracted position, shown in FIG. 5, spring 260 coils back into the housing 262 and is ready for the next cycle.

In case the capping mechanism malfunctions to the extent that upon attempting to place a cap on a cup the carrier mechanism 200 is unsuccessful and begins to return to its home position under sleeve 72, it is desirable to remove the cap from the carrier mechanism since the cap may be defective. To achieve this a small rectangular tab 264 is formed on the side of the sheet metal cup station (FIG. 3) which catches the leading edge (left edge as seen in FIG. 3) and pulls the cap off of the carrier mechanism so that it drops into a waste bin (not shown) in the bottom of the cabinet. If tab 264 is unsuccessful in removing the cap from the carrier mechanism, the rear edge of the cap will strike the leading edge of the next cap sitting in sleeve 72 which will then dislodge the cap from the carrier so that it falls into the bottom of the cabinet. If this is unsuccessful the cap will remain on the carrier and will again be placed on a cup in the cup station on the next cycle.

Figure 18:
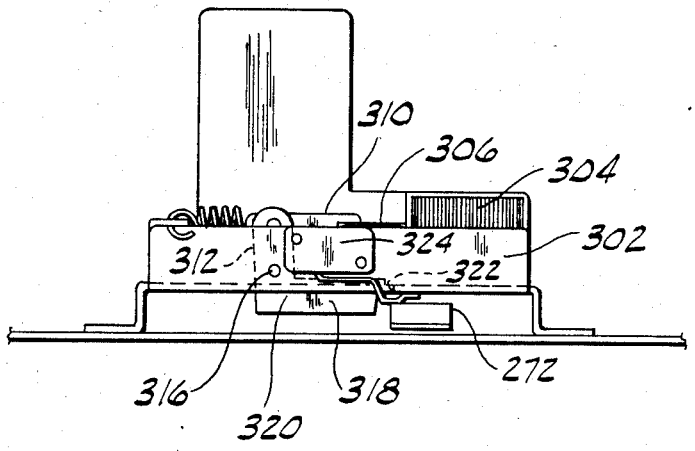
FIG. 18 is a view in the direction of arrows 18—18 in FIG. 17 showing a portion of the locking mechanism.
Figure 17:
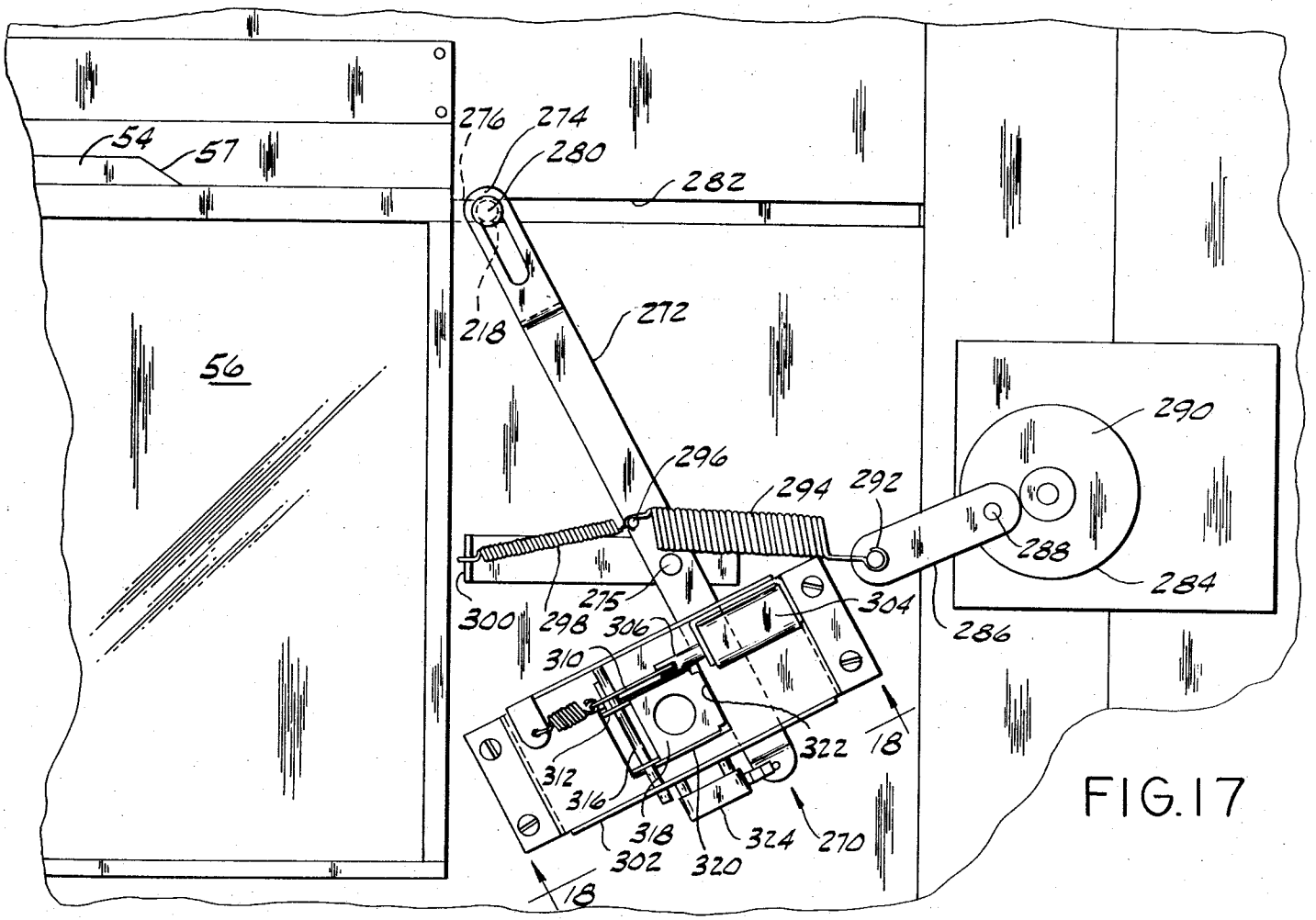
FIG. 17 is a partial view of the back of the vendor door showing the locking mechanism for the delivery door.

As shown in FIGS. 17 and 18, a delivery door locking mechanism, shown generally at 270, is provided in order to prevent customer access to the cup station 16 during the capping operation. The delivery door 56 is slidable back and forth to cover the opening in the front door of the cabinet, to either permit or prevent access to the cup station during filling and capping. An automatic door opening mechanism is provided, having a pivoting arm 272 with a slotted upper end portion 274. Arm 272 is pivotally mounted in its middle portion by a pivot pin 275 secured to the inside surface of the door of the beverage vendor 10.

The delivery door 56 is provided with a flange 276 on which is mounted a rotatable roller 278 on a pin 280 secured to flange 276. Roller 278 extends through a slot 282 in the inner surface of the cabinet door and is constrained within the slot in the slotted upper end portion 274 of arm 272 such that pivotal movement of arm 272 causes horizontal movement of the roller 278 and flange 276 along slot 282 to move the delivery door horizontally back and forth.

Pivoting of arm 272 is effected through motor 284 through a crank arm 286 pivotally mounted at 288 to an eccentric 290 on motor 284. A further pin 292 is fixed to an opposite end of crank arm 286 and a first spring 294 extends from pin 292 to arm 272 and is secured at that end by bolt 296. A second spring 298 is also secured at one end to bolt 296 and at its opposite end to a flange 300 mounted to the inner face of the cabinet door. The purpose of the spring connection to the motor is to allow the delivery door 56 to be moved by a customer against the action of motor 284.

Associated with the arm 272 is the locking mechanism 270. All of the locking mechanism 270 is supported on a mounting plate 302 which in turn is secured to the inner face of the cabinet door by bolting or the like. Mounted to plate 302 is a solenoid actuator 304 whose plunger 306 is pivotally attached at one end 308 to a connecting link 310. The opposite end of link 310 is, in turn, pivotally attached to an upper end portion of a crank arm 312 which has its lower end portion fixed to a rod 316 pivotally mounted at its end portions to mounting plate 302.

Fixed to rod 316 for pivotal movement therewith is locking plate 318 having downwardly extending flanges 320. Arm 272 is provided with a notch 322 on its lower end portion. Notch 322 is of slightly larger dimension than locking plate 318, and is so positioned that when the lower portion of lever arm 272 is rotated toward locking plate 318, as when the customer attempts to open the delivery door 56, the locking plate will engage the arm and prevent further rotation clockwise of arm 272 and thus prevent the delivery door 56 from being opened when the locking mechanism is activated. When locking plate 318 is in its up position, i.e., when solenoid actuator 304 is not activated, the lower portion of arm 272 is free to rotate under locking plate 318 and thus permit the upper portion of the arm 272 to pivot and open delivery door 56.

Positioned on the side of mounting plate 302 is a microswitch 324 which is located so as to be engaged by the lower end portion of the lever arm 272 when it is positioned so that the delivery door 56 is closed. Opening of door 56 moves the lower end portion of arm 272 off of the microswitch 324, opening it and thus providing an indication to the control circuitry that the door is other than in a closed position. This signal is utilized to inhibit activation of the capping mechanism when the delivery door is open or, at least, other than in a closed position.

The signal coming from microswitch 324 is checked by the control circuitry just prior to the normal point in the machine cycle in which the capping cycle is initiated. If the microswitch 324 indicates that the delivery access door is open, the capping sequence will not be initated and the cup 18, filled with beverage, will remain in the cup station 16 available to the customer, but without a cap. If, upon checking the microswitch 324, the control circuitry determines that the delivery door 56 is closed prior to initiation of the capping cycle, it will initiate the cycle to place a cap 70 on the filled beverage cup 18.

Reference will now be made to the manner of operation of the present invention. As viewed in FIG. 1, the customer inserts change in means 14 for accepting coins, and makes his beverage selection from the plurality of choices afforded by the means 12. A cup 18 (FIG. 2) is deposited in the cup station 16 and is then filled with the selected beverage, all as well known in the art. At this point, either through selection made by the customer or automatically depending upon which method is desired for a particular vendor 10, and assuming that the delivery door 56 is closed at the time the microswitch 324 has been interrogated by the control circuitry for the vendor 10, the capping cycle is initated. The cycle is initiated by sending a control signal to the digitized motor 82 which causes the output shaft 86 of the motor to rotate through 360° clockwise as shown in FIG. 5. As this occurs, the driven lever arm 100 begins to pivot to the left through the rotation of the first and second drive lever arms. Links 108 transmit the pivotal motion of arm 100 to slider 114 which, in turn, initiates its horizontal forward movement toward the cup station 16 as the rollers 132 of slider 114 move in their respective camming tracks 134 and 136.

As the slider 114 begins its movement, the ejector member 142 engages the contoured annular groove 188 of cap 70 and begins to draw cap 70 out of the sleeve 72 and off of the shelf 190 (FIG. 9). As movement of the slider 114, ejector member 142 and carrier mechanism 200 progresses toward the cup station, ejector member 142 continues to draw the cap 70 out of the sleeve 72 and down onto the carrier plate 206 of the carrier mechanism 200 (FIG. 10). Ejector member 142 then pulls downwardly away from the cap 70 (FIG. 11) which is now resting upon the carrier plate 206, in a position between those illustrated in FIGS. 10 and 11. The ejector 142 then continues to be drawn down away from the cap 70, carrier mechanism 200 and slider 14, through action of rollers 160 and camming track 172 as the slider continues its movement forward towards the capping station (FIG. 11).

As the carrier mechanism 200 advances toward the cup station 16 the constant force spring 260 is drawn out of its housing 262 on top of the cap 70 and holds it firmly against the carrier plate 206 as the slider continues to move to is fully extended position adjacent the cup station 16 (FIG. 13). At the maximum extent of movement, and at which time the cap 70 is positioned slightly beyond and above the cup 18 in the cup station 16, springs 221 and 223 cause the carrier side plates 202 and 204, and thus the carrier plate 206, to be pivoted about the pins 222 and 224 causing rollers 160 and 162 to move upwardly in the camming tracks 172 and 174, respectively. This also causes the carrier plate 206 and the cap 70 it is carrying, to be pivoted so that the outermost lip portion of the cap engages the outermost rim portion of the cup 18.

At this point, the slider 114 reverses its direction of movement, pulling the carrier mechanism 200 along with it so that the cap is drawn back over the top of the cap to catch the rim. As this movement continues, the rod 252 engages the upper surface of cap 70 and begins to force the lip of the cap down onto the rim of the cup, as the rod 252 is drawn over it. At the same time, carrier plate 206 is withdrawn from underneath the cap so that as the rod 252 progresses over the surface of the cap it is forced downwardly onto the rim of the cup. As the rearward movement of the carrier mechanism 200 continues, camming rollers 234 and 236 enter the portion of camming tracks 242 and 244, respectively, where they are prevented from moving downward during the last portion of travel of rod 252 over the cap (FIG. 14).

This restriction in movement is necessary in order to apply the added force needed to snap the cap lip on the rim of the cup (since otherwise only the springs 221 and 223 would be applying a counter force against the resistance of the cap being distorted to be applied to the rim of the cup). At the very end of this movement, the cap is somewhat distorted, as shown in FIG. 14, as the carrier plate 206 is withdrawn from beneath the cap 70 as rod 252 is drawn over this portion of the cap. The capping is completed when the roller 252 completes its movement across the top of the cap 70. The slider 114 and carrier mechanism 200 then continue their movement back to the retracted position. As this occurs, movement of the slider 114 draws the ejector 142 up the vertical portion of the cam track 172, and near the end of the return movement of the slider 114 ejector 142 engages the lower surface of the next lowermost cap 70 in the sleeve 72 where it is then ready for the next cycle. At this point, the delivery door locking mechanism 270 is deactivated and the delivery door 56 is opened by activation of motor 284 to permit the customer to remove his filled and capped beverage from the cup station 16.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a beverage vendor having a stationary cup station to which a cup is delivered from a cup supply and means operable upon registration of credit for a vend and selection by a customer to fill the cup at the cup station with a beverage:

means for capping each cup after it has been filled at the cup station with the filled and capped cup retrievable by the customer from the cup station comprising;

means for holding a stack of caps in the vendor spaced from the cup station;

carriage means operable on filling the cup at the cup station for ejecting a cap from the stack and carrying it to and placing it on a filled cup at the cup station and then returning to a position adjacent the means for holding a stack of caps, and means in the carriage means for pressing the cap down on the cup as the carriage returns to its position adjacent the means for holding a stack of caps.

2. A beverage vendor as defined in claim 1 wherein the carriage means includes:

a slide member mounted for horizontally reciprocating movement between a first position remote from the cup station and a second position over the cup station;

motor means for reciprocating the slide member;

an ejector member engagable with said cap in the cap holding means to eject the cap therefrom as the slide member moves from the first position;

means mounted to the slide member for supporting the cap for movement with the slide member from the first to the second position; and means holding the cap against the cap supporting means as the slide member moves from the first to the second position.

3. A beverage vendor as defined in claim 2 wherein the ejector member is pivotally mounted to the slide member and engageable with the lower surface of the lowermost cap in the stack of caps in such manner that movement of the slide member from the first position causes the ejector member to move the cap generally laterally away from the stack of caps holding means; and camming means associated with the ejector member to cause it to pivot downwardly away from the lowermost cap as the slide member moves from the first to the second position, so as to place the cap on the cap supporting means.

4. A beverage vendor as defined in claim 1 having a door for the cup station, means for locking the door closed, and means for inhibiting operation of the capping means if the door is unlocked.

5. In a beverage vendor having a stationary cup station to which a cup is delivered from a cup supply and means operable upon registration of credit for a vend and selection by a customer to fill the cup at the cup station with a beverage:

means for capping each cup after it has been filled at the cup station with the filled and capped cup retrievable by the customer from the cup station comprising;

means for holding a stack of cups in the vendor spaced from the cup station;

means operable on filling the cup at the cup station for ejecting a cap from the stack and carrying it to and placing it on a filled cup at the cup station;

means for pressing the cap down on the cup;

a delivery door mounted for reciprocally sliding movement to cover or uncover the cup station;

means for sensing whether the door is covering the cup station immediately prior to capping a cup in the cup station;

means for locking the door to cover the cup station during capping of a cup if the sensing means indicates the door is covering the cup station; and means for inhibiting capping of a cup in the cup station if the sensing means does not indicate the cup station is covered.

6. In a beverage vendor having a stationary cup station to which a cup is delivered from a cup supply and means operable upon registration of credit for a vend and selection by a customer to fill the cup at the cup station with a beverage:

means for holding a stack of caps in the vendor spaced from the cup station;

a carriage movable between a retracted and an advanced position relative to a cup at the cup station;

means on the carriage for ejecting a cap from the cap holding means as the carriage moved from its retracted to its advanced position and carrying the cap to and placing it on a filled cup at the cup station, leaving the cap on the cup as the carriage returns from its advanced to its retracted position; and means in the carriage for pressing the cap down on the cup as the carriage returns.

7. A drinking cup capping apparatus, comprising:

a stationary cup station;

means for supporting a cup in the cup station;

means for storing a stack of caps at a location remote from the cup station;

means for ejecting a single lowermost cap from the cap storing means and transporting it to the cup station above a cup disposed therein;

means for tilting the cap at the cup station so that a lip portion thereof engages a rim portion of the cup; and means engaging an upper surface of the cap and drawing laterally across the upper surface so as to cause the remainder of the lip of the cap to engage the remainder of the rim of the cup to affix the cap to the cup.

8. A capping apparatus as defined in claim 7 wherein the cap tilting means includes:

camming means associated with the cap ejecting means for pivoting at least a portion of the cap ejecting means as the lip portion of the single cap approaches the rim portion of the cup.

9. A capping apparatus as defined in claim 7 wherein the cap ejecting means includes:

a slide member mounted for horizontally reciprocating movement between a first position beneath the cap holding means and a second position over the cup station;

motor means for reciprocating the slide member;

an ejector member engagable with a lower surface of the lowermost cap in the cap holding means so as to eject the cap therefrom as the slide member moves from the first position;

means mounted to the slide member for supporting the cap for movement with the slide member from the first to the second position; and means holding the cap against the cap supporting means as the slide member moves from the first to the second position.

10. A capping apparatus as defined in claim 9 wherein the ejector member is pivotally mounted to the slide member and engagable with the lower surface of the cap in such manner that movement of the slide member from the first position causes the ejector member to move the cap generally laterally away from the cap storing means; and camming means associated with the ejector member to cause it to pivot downwardly away from the single cap as the slide member moves from the first to the second position to place the cap on the cap supporting means.

11. A capping apparatus as defined in claim 9 wherein the cap holding means includes a constant force strap spring having one end fixed adjacent the cap storing means and another end carried by the slide member so that a portion of the strap spring extends across the upper surface of a cap to hold it against the cap supporting means as it is transported with the slide member to the second position.

12. A capping apparatus as defined in claim 9 wherein the cap supporting means includes a cap carrier member pivotally mounted to the slide member, and the cap tilting means includes camming means associated with the carrier member for pivoting the carrier member on the slide member as the lip portion of the cap approaches the rim portion of the cup.

13. A capping apparatus as defined in claim 12 wherein the cap upper surface engaging means includes a rod supported by the carrier member for pivotal movement therewith and the camming means maintains the carrier member tilted as the rod engages and is drawn across the upper surface of the cap as the slide member is moved from the cup station toward the cap storing means and then the camming means pivots the carrier member to an untilted position wherein it is ready to receive a next cap from the cap storing means.

14. A capping apparatus as defined in claim 7, including means for initially partially separating the lowermost cap in the stack from a cap above it for positioning the lowermost cap for engagement by the ejector means.

15. A capping apparatus as defined in claim 14 wherein the initial cap separating means includes a shelf disposed beneath the stack and extending partially into the opening in the means supporting the stack through which the caps are removed, for tilting the lowermost cap away from the stack by the leverage of the cap on the shelf.

16. A capping apparatus as defined in claim 7 including means maintaining the cup in a substantially stationary position within said cup station while said cap engaging means is operative.

17. A method of capping a cup in a beverage vendor upon registration of credit for a vend and selection by a customer to fill the cup, the steps comprising:

delivering a cup to be capped from a cup storing device to a stationary cup station accessible to the customer;

filling the cup with the customer selection;

ejecting a cap from a stack of caps disposed remote from the cup station;

carrying the cap from the stack of caps to the cup station;

positioning a portion of a lip of the cap over a rim portion of the cup;

moving a capping member laterally across and in engagement with the upper surface of the cap, from the portion of the lip already on the cup to an opposite side of the cap so as to cause the lip of the cap to engage the rim of the cup around its complete periphery to affix the cap to the cup.

18. A method as defined in claim 17 wherein the ejecting step includes:

engaging a lower contoured surface of the cap with an ejector and moving the cap with the ejector substantially laterally away from the stack towards the cup station.

19. A method as defined in claim 18 wherein:

the carrying step includes, positioning the cap with the ejector on a carrier, moving the carrier substantially laterally toward the cup station, and retracting the ejector;

the positioning step includes, tilting the carrier over the cap at the cup station to cause the lip portion of the cap to engage the rim portion of the cup; and the moving step includes, returning the carrier to a position adjacent the stack for picking up a subsequent cap, the carrier having the capping member affixed thereto which is drawn over the upper surface of the cap as the carrier is moved to its position adjacent the stack.

* * * * *